US010077783B2

(12) United States Patent
Masuda et al.

(10) Patent No.: US 10,077,783 B2
(45) Date of Patent: Sep. 18, 2018

(54) ROTATION MECHANISM AND INTERNAL UNIT OF ROTATION MECHANISM

(71) Applicant: MITSUBISHI HEAVY INDUSTRIES COMPRESSOR CORPORATION, Tokyo (JP)

(72) Inventors: Tomohiro Masuda, Hiroshima (JP); Atsushi Higashio, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 566 days.

(21) Appl. No.: 14/237,968

(22) PCT Filed: Sep. 25, 2012

(86) PCT No.: PCT/JP2012/074538
§ 371 (c)(1),
(2) Date: Feb. 10, 2014

(87) PCT Pub. No.: WO2013/047507
PCT Pub. Date: Apr. 4, 2013

(65) Prior Publication Data

US 2014/0178183 A1 Jun. 26, 2014

(30) Foreign Application Priority Data

Sep. 28, 2011 (JP) ..... 2011-211928

(51) Int. Cl.
*F04D 29/42* (2006.01)
*F04D 29/62* (2006.01)
(Continued)

(52) U.S. Cl.
CPC ..... *F04D 29/4206* (2013.01); *F04D 17/125* (2013.01); *F04D 29/622* (2013.01);
(Continued)

(58) Field of Classification Search
CPC ..... F04D 29/60; F04D 29/601; F04D 29/605; F04D 29/62; F04D 29/624; F04D 29/628;
(Continued)

(56) References Cited

U.S. PATENT DOCUMENTS 2,556,384 A * 6/1951 Zeitz ..... F04D 29/605 166/75.11
2,578,617 A * 12/1951 Watson ..... F04D 17/122 415/199.3

(Continued)

FOREIGN PATENT DOCUMENTS

GB 1 381 904 1/1975
JP 56-92802 7/1981

(Continued)

OTHER PUBLICATIONS

Japanese Office Action dated Apr. 24, 2015 in corresponding Japanese Patent Application No. 2011-211928 with English translation.

(Continued)

*Primary Examiner* — Jason Shanske
*Assistant Examiner* — Julian Getachew
(74) *Attorney, Agent, or Firm* — Winderoth, Lind & Ponack, L.L.P.

(57) ABSTRACT

A rotation mechanism includes a casing with an upper half portion and a lower half portion; and an internal unit disposed in the casing with a rotor rotating around an axis thereof. Additionally, a bearing portion rotatably supports the rotor, and an annular seal portion seals a gap surrounding a circumferential surface of the rotor. An axial movement restricting portion includes a fitting concave portion on one of the casing and the internal unit, and a fitting convex portion to be fitted into the fitting concave portion as a pair, which restricts relative movement between the casing and (Continued)

the internal unit in a direction of axis. A tapered surface is formed on the fitting concave portion and the fitting convex portion and a width thereof in the direction of axis increases toward an inner circumferential side in a radial direction.

2 Claims, 6 Drawing Sheets

(51) Int. Cl.
*F04D 17/12* (2006.01)
*F04D 29/08* (2006.01)

(52) U.S. Cl.
CPC ..... *F04D 29/624* (2013.01); *F04D 29/083* (2013.01); *F05D 2230/64* (2013.01); *F05D 2230/68* (2013.01)

(58) Field of Classification Search
CPC .. F04D 29/426; F04D 29/4206; F04D 17/122; F16L 15/06
See application file for complete search history.

(56) References Cited

U.S. PATENT DOCUMENTS 2,781,999 A * 2/1957 Brennecke ..... F01D 25/265 415/193
4,600,224 A * 7/1986 Blose ..... E21B 17/042 285/332.4

FOREIGN PATENT DOCUMENTS

| | | |
|---|---|---|
| JP | 58-013781 | 3/1983 |
| JP | 59-054800 | 3/1984 |
| JP | 60-081984 | 6/1985 |
| JP | 60-180800 | 11/1985 |
| JP | 63-170591 | 7/1988 |
| JP | 04-323192 | 11/1992 |
| JP | 2001-254697 | 9/2001 |
| JP | 2009-513863 | 4/2009 |
| JP | 2009-185608 | 8/2009 |

OTHER PUBLICATIONS

Extended European Search Report dated May 4, 2015 in corresponding European Patent Application No. 12836322.3.

International Search Report dated Dec. 18, 2012 in International (PCT) Application No. PCT/JP2012/074538 with English translation.

Written Opinion of the International Searching Authority dated Dec. 18, 2012 in International (PCT) Application No. PCT/JP2012/074538 with English translation.

* cited by examiner

ROTATION MECHANISM AND INTERNAL UNIT OF ROTATION MECHANISM

TECHNICAL FIELD

The present invention relates to a rotation mechanism in which an internal unit including a rotor configured to be driven to rotate around an axis thereof is accommodated in a casing thereof.

Priority is claimed on Japanese Patent Application No. 2011-211928, filed on Sep. 28, 2011, the content of which is incorporated herein by reference.

BACKGROUND ART

As a rotation mechanism in which a rotor that is driven to rotate around its axis is accommodated in a casing thereof, there is a centrifugal compressor which compresses gas using a centrifugal force. As the centrifugal compressor, a so-called barrel-type compressor having a cylindrical casing and a so-called split-type compressor having a casing that can be split into two portions are known (for example, refer to PTL 1). Here, in the barrel-type compressor, components other than the casing, that is, an internal unit having a rotor, a bearing, a seal member, and the like that are integrally configured are accommodated. In a case where maintenance in the inside of the barrel-type compressor is performed, by pulling out the internal unit from one end opening of the cylindrical casing, the components in the inside thereof can be collectively replaced. The barrel-type compressor has a high internal airtightness and thus is likely to be applied to centrifugal compressors having a high internal pressure.

On the other hand, in the split-type compressor, when the casing on the upper side among the casings which can be split into two portions is detached, the bearing and the seal member are removed along with the casing on the upper side. Accordingly, the rotor and the like inside are exposed, and the maintenance in the inside can be performed at a place where the compressor is installed. In the split-type compressor, since the casings can be split into two portions, compared to the barrel-type compressor, the internal airtightness is poor, and thus the split-type compressor is likely to be applied to centrifugal compressors having a low internal pressure.

However, as a sea compressor used in the facilities which refine petroleum or natural gas on a ship, the barrel-type compressor is mainly used. This is because it is difficult to perform maintenance in the inside of the compressor on the sea where only a limited space and a minimum number of personnel can be ensured. Therefore, the barrel-type compressor which can be easily maintained by collectively replacing the components in the inside thereof is appropriate.

CITATION LIST

Patent Literature

[PTL 1] Published Japanese Translation No. 2009-513863 of the PCT International Publication

SUMMARY OF INVENTION

However, in the conventional barrel-type compressor which is mainly used as the sea compressor, since the internal unit needs to be pulled out from one end opening of the casing as described above, there are problems in that a sufficient space needs to be secured adjacent to the compressor and it is difficult to perform an operation of pulling out the internal unit from the casing in a transverse direction.

The present invention provides a rotation mechanism which can be easily maintained by collectively replacing an internal unit thereof and in which the internal unit can be taken out without securing a surrounding space.

According to a first aspect of the present invention, a rotation mechanism, includes: a casing which is configured to be vertically split into two portions and includes an upper half portion on an upper side and a lower half portion on a lower side; an internal unit which is disposed in the casing and has a configuration in which a rotor which rotates around an axis thereof, a bearing portion which rotatably supports the rotor, and an annular seal portion which seals a gap surrounding a circumferential surface of the rotor so as to enable the rotor to rotate are integrated; an axial movement restricting portion which includes a fitting concave portion provided in one of the casing and the internal unit and a fitting convex portion provided in the other thereof to be fitted into the fitting concave portion as a pair and restricts relative movement between the casing and the internal unit in a direction of axis; and a tapered surface which is formed on each of the fitting concave portion and the fitting convex portion so that a width thereof in the direction of axis increases toward an inner circumferential side in a radial direction.

According to this configuration, the upper half portion of the casing is removed, the internal unit is taken out from the lower half portion of the casing by pulling it up, and thereafter a new internal unit is pulled down to be mounted on the half portion of the casing. Therefore, the components in the rotation mechanism can be collectively replaced. Accordingly, even in a case where a sufficient surrounding space cannot be secured on the sea, for example, the maintenance of the internal unit can be easily performed.

In addition, by fitting the fitting concave portion formed on one of the internal unit and the casing and the fitting convex portion formed on the other thereof together, relative movement between the internal unit and the casing in the direction of axis can be restricted.

Furthermore, when the internal unit is mounted on the casing, there may be a case where the internal unit slightly deviates from a position where the fitting concave portion and the fitting convex portion are properly fitted together in the direction of axis. Even in this case, the internal unit is guided to the proper position by the tapered surfaces formed on the fitting concave portion and the fitting convex portion, and thus the fitting concave portion and the fitting convex portion are reliably fitted together.

In addition, according to a second aspect of the present invention, in each of cross-sections of the fitting concave portion and the fitting convex portion in the radial direction, the tapered surface is formed only on a side wall on a rearward side in an operational direction of an axial force applied to the internal unit.

According to this configuration, the tapered surface is formed only on the side wall on the rearward side in the operational direction of the axial force, and is not formed on the side wall on the forward side. Therefore, there is no loss of function of the axial movement restricting portion regardless of the presence of the tapered surface, and relative movement between the casing and the internal unit in the direction of axis due to the action of the axial force can be reliably restricted by the side wall on the forward side.

In addition, according to a third aspect of the present invention, the tapered surface may be formed only on a part of the fitting concave portion and the fitting convex portion adjacent to a joint portion of the upper half portion and the lower half portion of the casing.

According to this configuration, in a case where the internal unit slightly deviates from the proper position in the direction of axis when the internal unit is mounted on the casing, in the vicinity of the joint portion of the upper half portion and the lower half portion which is the position where the fitting concave portion and the fitting convex portion are initially fitted together, the internal unit is guided to the proper position by the tapered surface. Therefore, when the fitting concave portion and the fitting convex portion start to be fitted together at a position distant from the vicinity of the joint portion, the internal unit is already at the proper position, and the fitting concave portion and the fitting convex portion are reliably fitted together even though the tapered surface is not formed thereon.

In addition, according to the first aspect of the present invention, an internal unit of a rotation mechanism, which is disposed in a casing that is configured to be vertically split into two portions and includes an upper half portion on the upper side and a lower half portion on the lower side, and has a configuration in which a rotor which rotates around an axis thereof, a bearing portion which rotatably supports the rotor, and an annular seal portion which seals a gap surrounding a circumferential surface of the rotor so as to enable the rotor to rotate are integrated, includes an axial movement restricting portion which includes a fitting concave portion provided on one of the casing and the internal unit and a fitting convex portion provided on the other thereof to be fitted into the fitting concave portion as a pair and restricts relative movement between the casing and the internal unit in a direction of axis; and a tapered surface which is formed on each of the fitting concave portion and the fitting convex portion so that the width thereof in the direction of axis increases toward an inner circumferential side in a radial direction.

According to this configuration, the upper half portion of the casing is removed, the internal unit is pulled up to be taken out from the lower half portion of the casing, and thereafter a new internal unit is pulled down to be mounted on the lower half portion of the casing. Therefore, the components in the rotation mechanism can be collectively replaced. Accordingly, even in a case where a sufficient surrounding space cannot be secured on the sea, for example, the maintenance of the internal unit can be easily performed.

In addition, by fitting the fitting concave portion formed on one of the internal unit and the casing and the fitting convex portion formed on the other thereof together, relative movement between the internal unit and the casing in the direction of axis can be restricted.

Furthermore, when the internal unit is mounted on the casing, there may be a case where the internal unit slightly deviates from a position where the fitting concave portion and the fitting convex portion are properly fitted together in the direction of axis. Even in this case, the internal unit is guided to the proper position by the tapered surfaces formed on the fitting concave portion and the fitting convex portion, and thus the fitting concave portion and the fitting convex portion are reliably fitted together.

According to the rotation mechanism and the internal unit of the rotation mechanism according to the present invention, the maintenance can be facilitated by collectively replacing the internal unit, and the internal unit can be taken out without securing the surrounding space.

DESCRIPTION OF EMBODIMENTS

Hereinafter, an exemplary embodiment of the present invention will be described with reference to the drawings.

Figure 1:
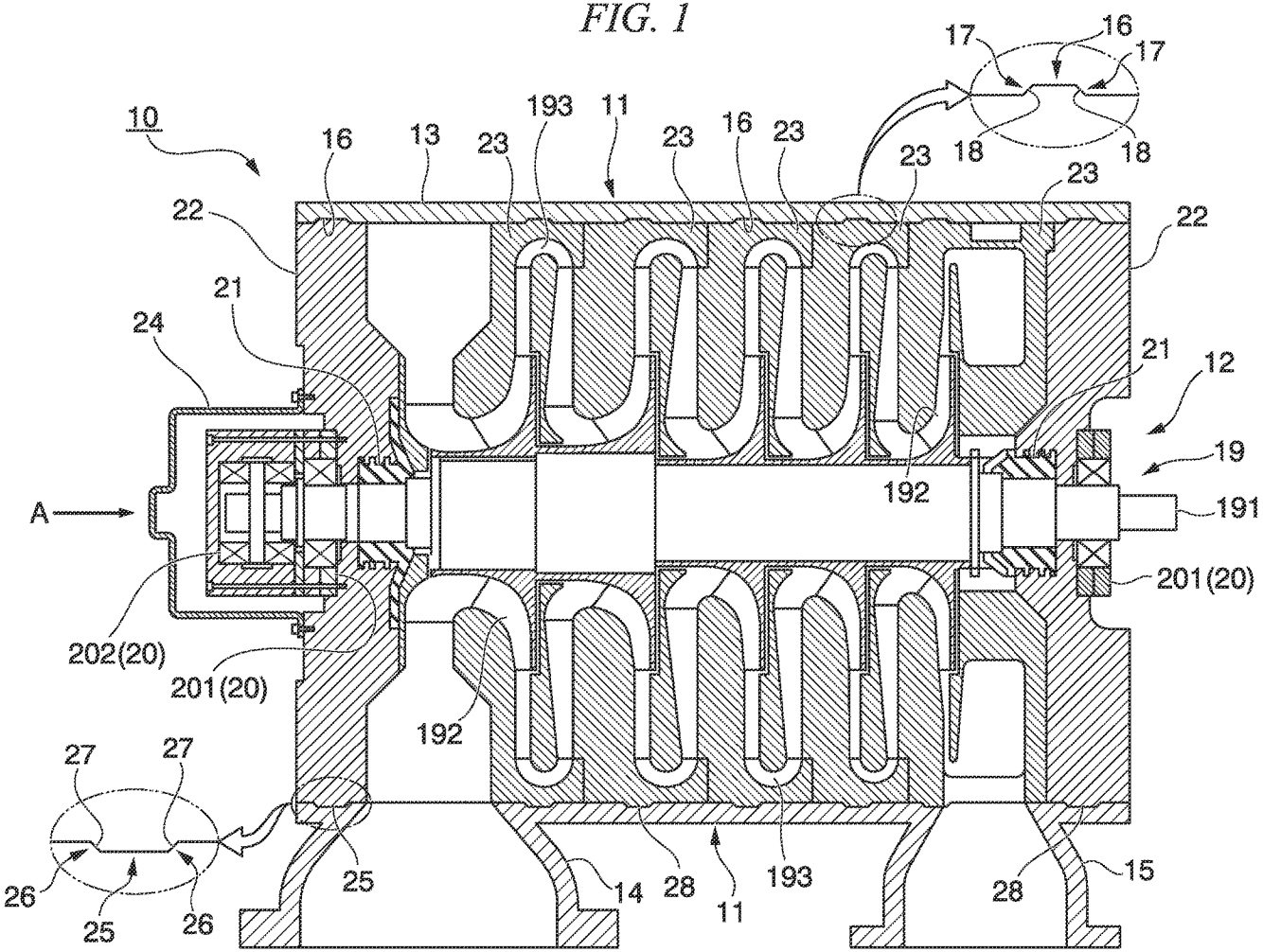
FIG. 1 is a cross-sectional view in a radial direction illustrating the configuration of a sea centrifugal compressor according to an embodiment of the present invention.
Figure 2:
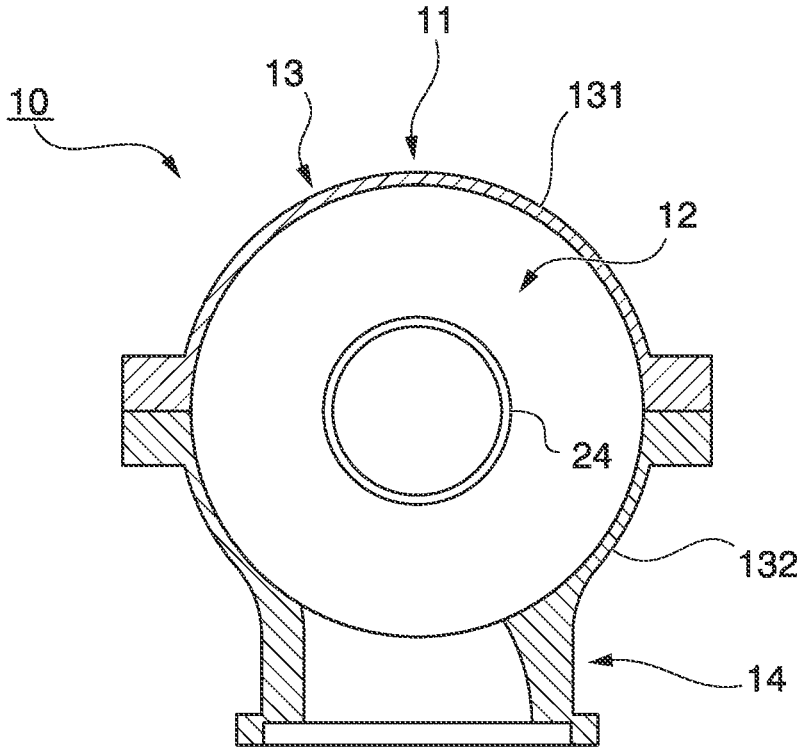
FIG. 2 is a diagram taken along the arrow in an A direction in FIG. 1.

First, the configuration of a rotation mechanism according to the embodiment of the present invention will be described. FIGS. 1 and 2 are diagrams illustrating a sea centrifugal compressor 10 as the rotation mechanism according to this embodiment, FIG. 1 is a cross-sectional view in a radial direction, and FIG. 2 is a diagram taken along the arrow in an A direction in FIG. 1.

As illustrated in FIG. 1, the sea centrifugal compressor 10 includes a casing 11 as a housing and an internal unit 12 accommodated in the casing 11.

As illustrated in FIGS. 1 and 2, the casing 11 includes a casing body 13 having a substantially cylindrical shape, a suction port 14 which supplies gas to be compressed into the casing body 13, and a discharge port 15 which discharges the compressed gas from the inside of the casing body 13.

As illustrated in FIG. 2, the casing body 13 is vertically split into two portions by a horizontal plane, and thus includes an upper half portion 131 and a lower half portion 132. As illustrated in FIG. 1, in the inner circumferential surfaces of the upper half portion 131 and the lower half portion 132, fitting concave portions 16 (axial movement restricting portions) having a substantially trapezoidal cross-section are formed to extend along a circumferential direction. The fitting concave portions 16 and fitting convex portions 25 and 28, which will be described later, restrict relative movement between the casing 11 and the internal unit 12, and a plurality of lines of the fitting concave portions 16 are formed at predetermined intervals in the direction of axis.

Here, as illustrated by the enlarged part in FIG. 1, the fitting concave portion 16 has a tapered surface 18 formed on each of side walls 17 in the cross-section in the radial direction. The tapered surface 18 is formed so that the width thereof in the direction of axis gradually increases from the outer circumferential side to the inner circumferential side along the radial direction. The number of fitting concave portions 16, the interval between the adjacent fitting concave portions 16, and the like are not limited to those of this embodiment, and may be appropriately changed depending on the design.

As illustrated in FIG. 1, the internal unit 12 includes a rotor 19 which is provided to be inserted into the casing body 13 in the direction of axis, a bearing portion 20 which supports the rotor 19 to rotate around the axis thereof, a pair of seal portions 21 which seal both end portions of the rotor 19 in the direction of axis, a pair of heads 22 which respectively seal both end openings of the casing body 13, and a plurality of diaphragms 23 which cover the periphery of the rotor 19 with gaps having predetermined widths. The internal unit 12 is not limited to the configuration of this embodiment, and the internal unit 12 may be configured to include other components excluding the casing 11 among the components of the sea centrifugal compressor 10.

(Rotor)

The rotor 19 includes a plurality of impellers 192 fixed to circumferential surface of a rotating shaft 191, which is driven to rotate, along the direction of axis. A gas flow passage 193 having a predetermined width is formed by the rotor 19, the diaphragms 23, and the heads 22. Both ends of the gas flow passage 193 are respectively connected to the suction port 14 and the discharge port 15. In this embodiment, although five stages of impellers 192 are provided along the direction of axis of the rotating shaft 191, the number of stages of the impellers 192 is not limited thereto, and may be appropriately changed depending on the design.

(Bearing Portion)

The bearing portion 20 rotatably supports the rotating shaft 191 included in the rotor 19 around the axis thereof. As illustrated in FIG. 1, the bearing portion 20 includes a pair of journal bearings 201 which are provided in both end portions of the rotor 19 in the direction of axis and a thrust bearing 202 which is provided in one end portion of the rotor 19 in the direction of axis.

The pair of journal bearings 201 receives a load, which is exerted on the rotating shaft 191 in the radial direction. The journal bearings 201 are respectively fixed to the outer side surfaces of the pair of heads 22 using fixing means such as bolts.

The thrust bearing 202 receives a load in the direction of axis, which is exerted on the rotating shaft 191. As illustrated in FIG. 1, the thrust bearing 202 is mounted on a bearing cover 24 having a box shape, and the bearing cover 24 is fixed to the outer surface of one head 22 using fixing means such as bolts.

(Seal Portion)

The pair of seal portions 21 have a role of sealing gaps between the rotating shaft 191 included in the rotor 19 and the heads 22. The seal portions 21 are so-called dry gas seals, are formed in a ring shape to surround the rotating shaft 191 as illustrated in FIG. 1, and are respectively fixed to the inner surfaces of the pair of heads 22 using fixing means such as bolts.

(Head)

As illustrated in FIG. 1, the pair of heads 22 are substantially columnar members, and the outside diameters thereof are formed to be approximately equal to those of both end openings of the casing body 13. Both end portions of the rotating shaft 191 included in the rotor 19 are respectively inserted into the heads 22. In addition, in each head 22, the fitting convex portion 25 (the axial movement restricting portion) having a substantially trapezoidal cross-section is formed to protrude from the outer circumferential surface thereof and extend along the circumferential direction. The fitting convex portion 25 is fitted into the fitting concave portion 16 so as to restrict the relative movement between the casing 11 and the internal unit 12.

Here, as illustrated by the enlarged part in FIG. 1, in the fitting convex portion 25, a tapered surface 27 is formed on each side wall 26 in the cross-section in the radial direction. As in the tapered surface 18 of the fitting concave portion 16, the tapered surface 27 is formed so that the width thereof in the direction of axis gradually increases from the outer circumferential side to the inner circumferential side in the radial direction. The number of fitting convex portions 25, the interval between the adjacent fitting convex portions 25, and the like are not limited to those of this embodiment, and may be appropriately changed depending on the design.

(Diaphragm)

As illustrated in FIG. 1, the diaphragm 23 is a substantially annular member, and is formed to have the fitting convex portion 28 (the axial movement restricting portion) having a substantially trapezoidal cross-section, which protrudes from the outer circumferential surface thereof and extends along the circumferential direction. The fitting convex portion 28 of the diaphragm 23 has the same shape and function as the fitting convex portion 25 of the head 22, and thus a description thereof will be omitted here.

As illustrated in FIG. 1, five diaphragms 23 are provided along the direction of axis of the rotating shaft 191. Although not illustrated in the figure in detail, the adjacent diaphragms 23 are fixed together by welding. In addition, in the five diaphragms 23 which are integrated, the diaphragm 23 which is positioned at one end portion thereof is fixed to the inner surface of one head 22 using fixing means such as bolts.

The fixing of the adjacent diaphragms 23 is not limited to the welding, and another fixing means may also be used. In addition, in this embodiment, the five diaphragms 23 are provided corresponding to the number of stages of the impellers 192. However, the number of diaphragms 23 is not limited thereto, and may be appropriately changed depending on the design.

As described above, since the rotor 19, the bearing portion 20, the seal portions 21, the pair of heads 22, and the five diaphragms 23 which constitute the internal unit 12 are fixed to each other, the internal unit 12 is integrally configured.

(Maintenance Procedure)

Figure 3:
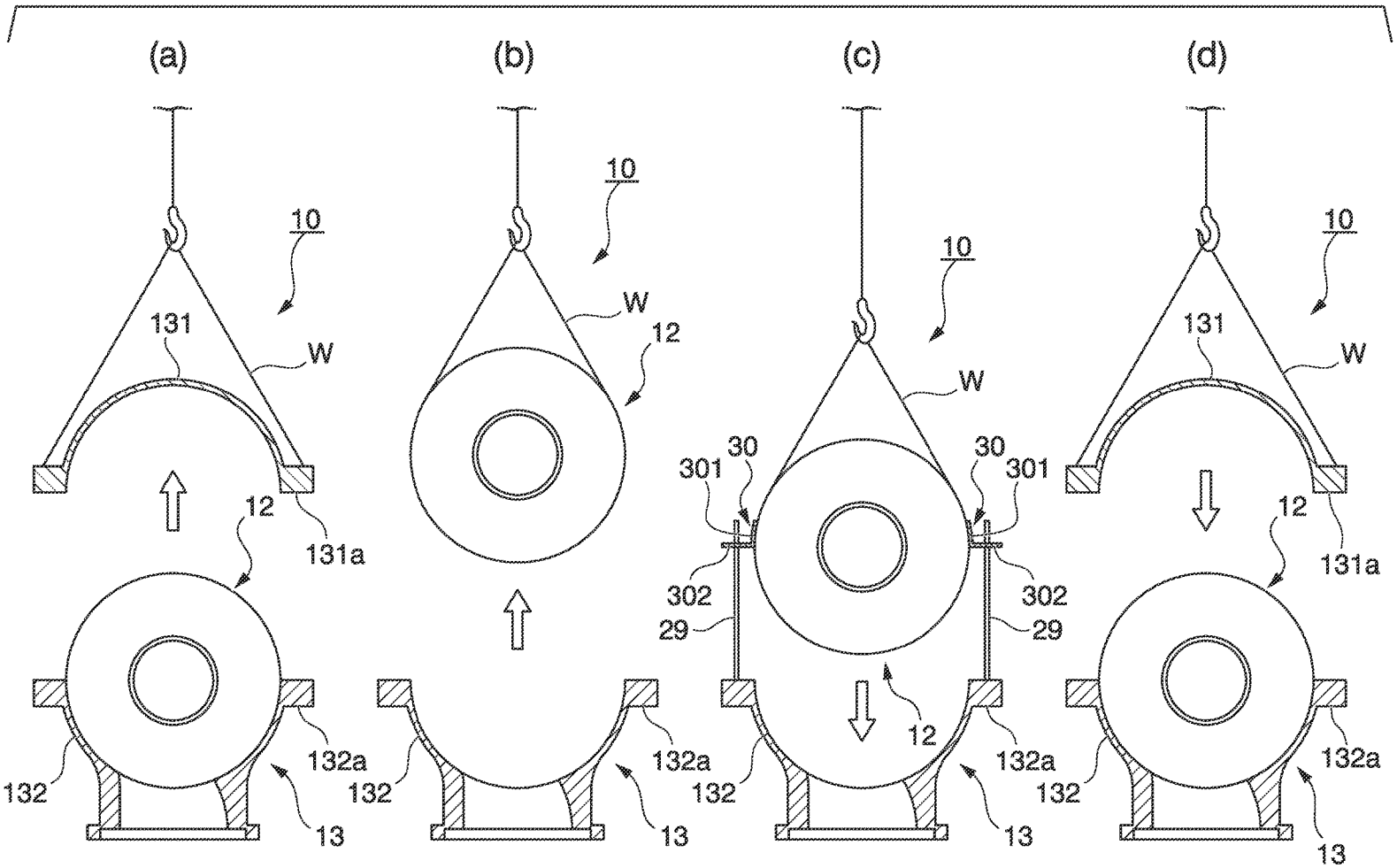
FIG. 3 is an explanatory view illustrating a maintenance procedure of the sea centrifugal compressor according to the embodiment of the present invention.

Next, a maintenance procedure of the sea centrifugal compressor 10 according to this embodiment and an operational effect thereof will be described. FIG. 3 is an explanatory view illustrating the maintenance procedure of the sea centrifugal compressor 10 according to this embodiment. First, in a state illustrated in FIG. 2, a worker who performs maintenance removes the fixing means such as bolts used to fix the upper half portion 131 and the lower half portion 132 constituting the casing body 13 so that the upper half portion 131 and the lower half portion 132 are in a splittable state.

Subsequently, as illustrated in FIG. 3(*a*), the worker fixes a wire W to the upper half portion 131 and winds up the wire W using a crane (not illustrated) to split the upper half portion 131 from the lower half portion 132 so as to pull up the upper half portion 131. Accordingly, a part of the internal unit 12 is in a state of being exposed.

Subsequently, as illustrated in FIG. 3(*b*), the worker fixes the wire W to the exposed part of the internal unit 12, and pulls up the internal unit 12 by winding up the wire W using the crane. Accordingly, the internal unit 12 is taken out from the lower half portion 132.

Subsequently, as illustrated in FIG. 3(*c*), the worker allows a spare internal unit 12 to be accommodated in the lower half portion 132 of the casing 11 instead of the taken-out internal unit 12. That is, first, the worker respectively mounts bar-like guide bars 29 onto flanges 132*a* which protrude from the lower half portion 132 toward both sides thereof respectively so as to extend upward. Subsequently, the worker mounts a pair of guide plates 30 to both side portions of the spare internal unit 12 respectively.

Figure 4:
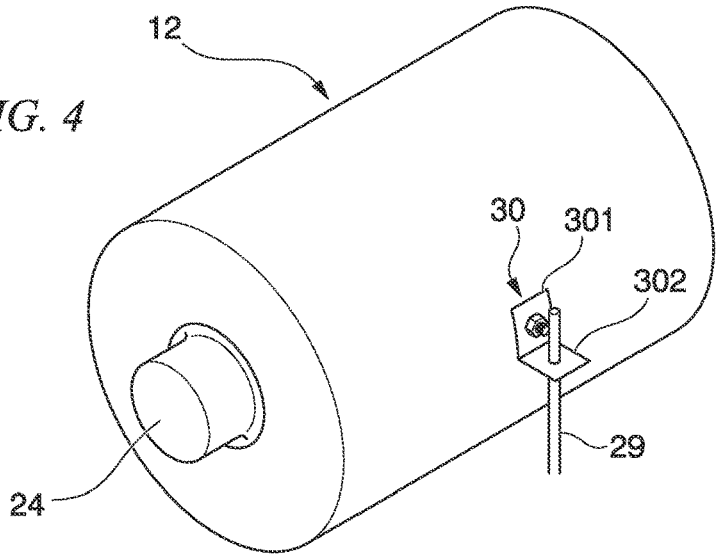
FIG. 4 is a schematic perspective view schematically illustrating a state where a guide plate is mounted on an internal unit.

FIG. 4 is a schematic perspective view schematically illustrating a state where the guide plate 30 is mounted on the internal unit 12. The guide plate 30 is a flat plate member having a substantially L-shaped cross-section which has an angle of substantially 90° between a mounting piece 301 and a protruding piece 302. The worker allows the mounting piece 301 of the guide plate 30 to abut the spare internal unit 12 on the side portion thereof, and fixes the mounting piece 301 to the internal unit 12 using a bolt. Accordingly, as illustrated in FIGS. 3(*c*) and 4, the protruding pieces 302 are in a state of respectively protruding from both side portions of the spare internal unit 12 toward both sides thereof.

The worker fixes the wire W to the internal unit 12 on which the guide plate 30 is mounted and winds up the wire W using the crane to temporarily pull up the spare internal unit 12. Furthermore, the worker lowers the spare internal unit 12 by operating the crane, and inserts the pair of guide bars 29 into the protruding pieces 302 of the pair of guide plates 30 mounted on both side portions of the spare internal unit 12. Thereafter, the worker further lowers the spare internal unit 12 by operating the crane, and then the internal unit 12 is lowered along the pair of guide bars 29.

When the spare internal unit 12 is lowered to the vicinity of the lower half portion 132, the worker removes the guide plates 30 from both side portions of the internal unit 12, and removes the pair of guide bars 29 from the lower half portion 132. Thereafter, the worker lowers the internal unit 12 to the inside of the lower half portion 132.

Figure 5:
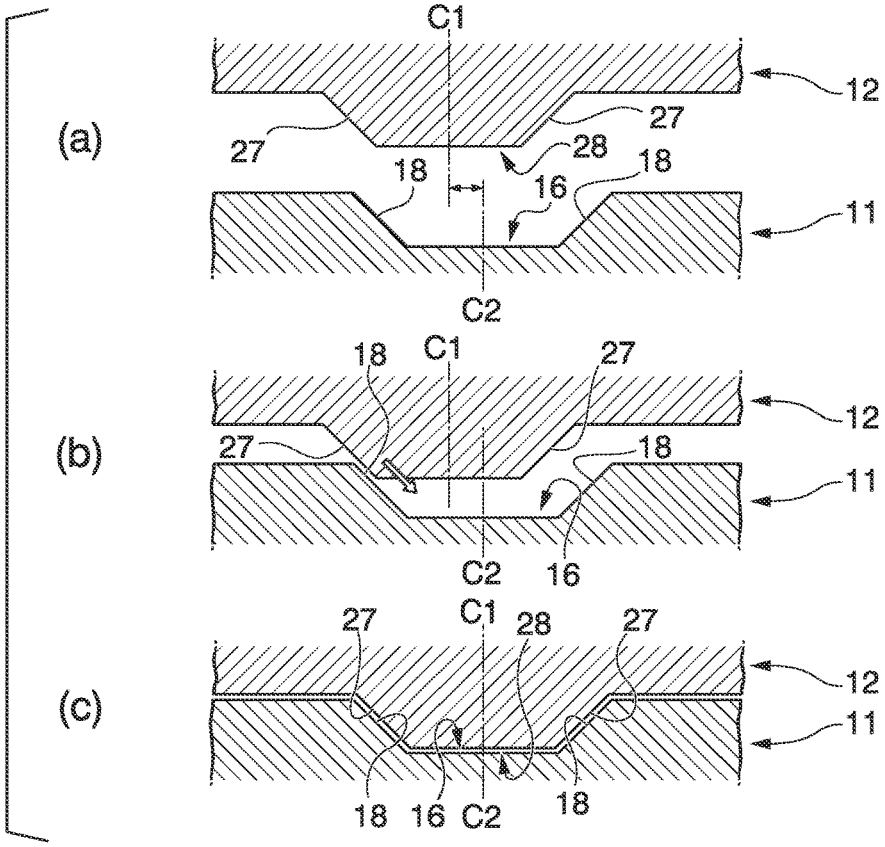
FIG. 5 is a schematic cross-sectional view illustrating the positioning of an internal unit and a casing in a direction of axis.

Here, FIG. 5 is a schematic cross-sectional view illustrating the positioning of the spare internal unit 12 and the casing 11 in the direction of axis. When the internal unit 12 is lowered to the inside of the lower half portion 132, there may be a case where the internal unit 12 slightly deviates from a proper position in the direction of axis. Here, the proper position of the internal unit 12 means a state where a first center line C1 of the fitting convex portion 28 of the internal unit 12 and a second center line C2 of the fitting concave portion 16 of the lower half portion 132 are not aligned with each other but are split in the direction of axis by a predetermined distance as illustrated in FIG. 5(*a*).

In this case, when the internal unit 12 is further lowered from the state of FIG. 5(*a*), as illustrated in FIG. 5(*b*), the tapered surface 27 of the fitting convex portion 28 comes into contact with the tapered surface 18 of the fitting concave portion 16. When the internal unit 12 is further lowered from this state, the fitting convex portion 28 is caused to slide obliquely downward along the tapered surface 18 of the fitting concave portion 16. Accordingly, the first center line C1 of the fitting convex portion 28 gradually approaches the second center line C2 of the fitting concave portion 16.

When the internal unit 12 is further lowered from the state of FIG. 5(*b*), as illustrated in FIG. 5(*c*), the first center line C1 of the fitting convex portion 28 is aligned with the second center line C2 of the fitting concave portion 16.

At this time, the fitting convex portion 28 is completely fitted into the fitting concave portion 16. As described above, even in a case where the internal unit 12 deviates from the proper position in the direction of axis, the internal unit 12 is guided to the proper position by the tapered surface 18 of the fitting concave portion 16 and the tapered surface 27 of the fitting convex portion 28, and thus the fitting convex portion 28 can be reliably fitted into the fitting concave portion 16. Accordingly, even when the internal unit 12 or the lower half portion 132 is subjected to an axial force during the operation of the sea centrifugal compressor 10, relative movement between the internal unit 12 and the lower half portion 132 in the direction of axis is restricted.

Finally, as illustrated in FIG. 3(*d*), the worker allows the upper half portion 131 and the lower half portion 132 to be integrated. That is, the worker fixes the wire W to the upper half portion 131 which is split as described above, and pulls up the upper half portion 131 by winding up the wire W using the crane to pull up the upper half portion 131. The upper half portion 131 is lowered by operating the crane, and joins a pair of flanges 131 a which protrude from the upper half portion 131 toward both sides thereof to the flanges 132*a* which protrude from the lower half portion 132 toward both sides thereof.

At this time, when the upper half portion 131 is lowered, there may be a case where the upper half portion 131 slightly deviates from the proper position in the direction of axis. However, in this case, as in the case of lowering the internal unit 12, the upper half portion 131 is guided to the proper position by the tapered surface 18 of the fitting concave portion 16 and the tapered surface 27 of the fitting convex portion 28, and thus the fitting convex portion 28 of the internal unit 12 can be reliably fitted into the fitting concave portion 16 of the upper half portion 131. Accordingly, even when the internal unit 12 or the upper half portion 131 is subjected to the axial force during the operation of the sea centrifugal compressor 10, relative movement between the internal unit 12 and the upper half portion 131 in the direction of axis is restricted.

Although not illustrated in the figure in detail, the worker fixes the upper half portion 131 and the lower half portion 132 to each other using the fixing means such as bolts after removing the wire W from the upper half portion 131. In this way, the maintenance of replacing the internal unit 12 with the spare internal unit 12 is completed.

(Modified Examples of Axial Movement Restricting Portion)

Figure 6:
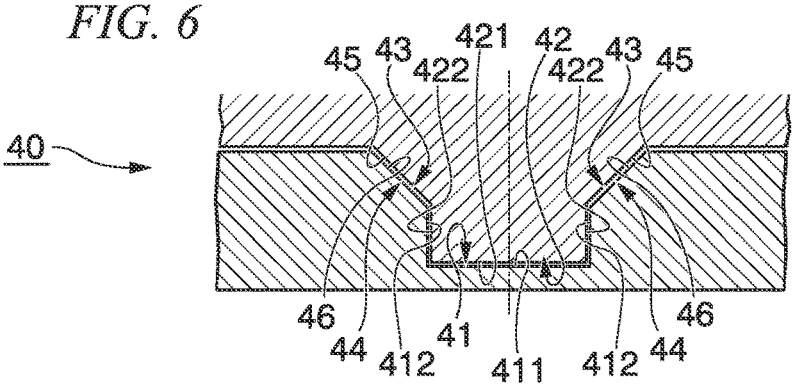
FIG. 6 is a schematic cross-sectional view illustrating an axial movement restricting portion according to a first modified example.

The cross-sectional shapes of the fitting concave portion 16 and the fitting convex portion 28 are not limited to the substantially trapezoidal cross-sectional shape of this embodiment, and may be appropriately changed depending on the design. FIG. 6 is a schematic cross-sectional view illustrating an axial movement restricting portion 40 according to a first modified example. A fitting concave portion 41 and a fitting convex portion 42 of this modified example are the same as the fitting concave portion 16 and the fitting convex portion 28 according to the embodiment of the present invention in that tapered surfaces 45 and 46 are respectively formed on side walls 43 and 44 in the cross-section in the radial direction, but are different from them in that the tapered surfaces 45 and 46 are formed only on parts of the side walls 43 and 44. More specifically, in the fitting concave portion 41 and the fitting convex portion 42 of this modified example, the tapered surfaces 45 and 46 are respectively formed only on the opening edge portion of the fitting concave portion 41 and on the base end portion of the fitting convex portion 42. Therefore, in the bottom portion of the fitting concave portion 41, vertical portions 412 perpendicular to a bottom surface 411 are formed. In addition, in the tip end portion of the fitting convex portion 42, vertical portions 422 perpendicular to a top surface 421 are formed. According to this configuration, loss of function of the fitting concave portion 41 and the fitting convex portion 42 is suppressed and minimized by the presence of the tapered surfaces 45 and 46, and the relative movement between the casing 11 and the internal unit 12 in the direction of axis due to the action of the axial force can be reliably restricted by the joining of the vertical portion and the vertical portion.

Figure 7:
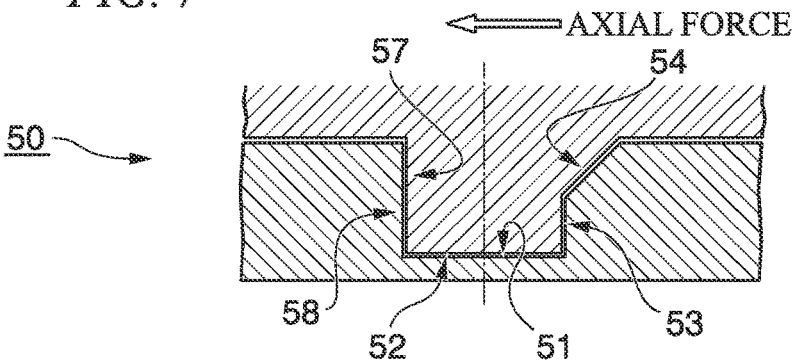
FIG. 7 is a schematic cross-sectional view illustrating an axial movement restricting portion according to a second modified example.

FIG. 7 is a schematic cross-sectional view illustrating an axial movement restricting portion 50 according to a second modified example. A fitting concave portion 51 and a fitting convex portion 52 of this modified example are different from the fitting concave portion 41 and the fitting convex portion 42 of the first modified example in that tapered surfaces 55 and 56 are formed only on side walls 53 and 54 on the rearward side in the operational direction of the axial force and are not formed on side walls 57 and 58 on the forward side. According to this configuration, there is no loss of function of the fitting concave portion 51 and the fitting convex portion 52 regardless of the presence of the tapered surfaces 55 and 56, and the relative movement between the casing 11 and the internal unit 12 in the direction of axis due to the action of the axial force can be reliably restricted by the joining of the side walls 57 and 58 on the forward side.

Figure 8:
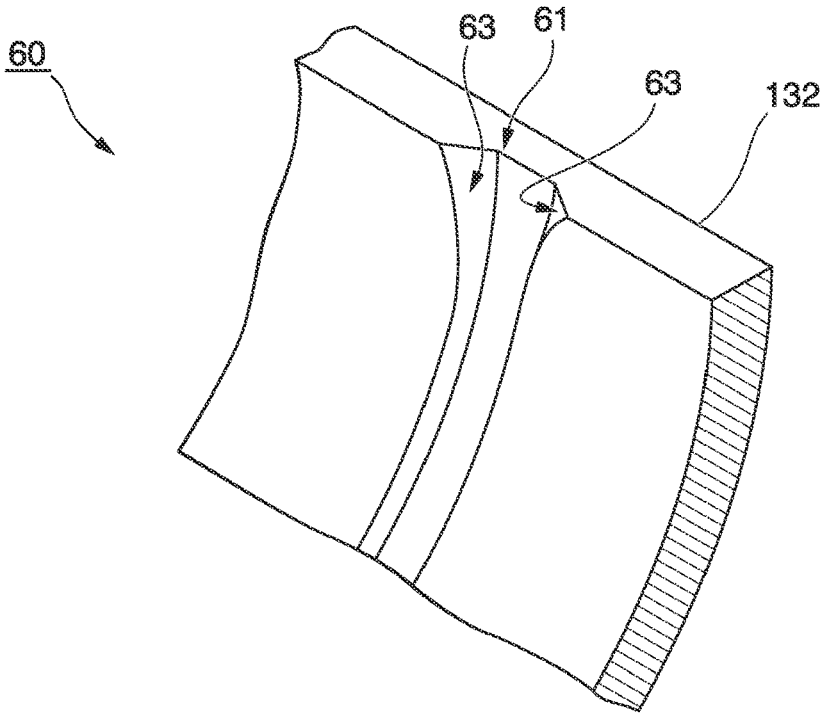
FIG. 8 is a schematic cross-sectional view illustrating an axial movement restricting portion according to a third modified example.

FIG. 8 is a schematic cross-sectional view illustrating a fitting concave portion 61 of an axial movement restricting portion 60 according to a third modified example. The fitting concave portion 61 of this modified example is different from the fitting concave portion 16 and the fitting convex portion 28 according to the embodiment of the present invention in that tapered surfaces 63 are formed only on a part of the fitting concave portion 61 adjacent to a joint portion of the upper half portion 131 and the lower half portion 132 (only the lower half portion 132 is illustrated in FIG. 8) of the casing 11 illustrated in FIG. 2. According to this configuration, in a case where the internal unit 12 slightly deviates from the proper position in the direction of axis when the internal unit 12 is mounted in the casing 11, in the vicinity of the joint portion of the upper half portion 131 and the lower half portion 132 which is the position where the fitting concave portion 61 and a fitting convex portion 62 are initially fitted together, the internal unit 12 is guided to the proper position by the tapered surface 63. Therefore, when the fitting concave portion 61 and the fitting convex portion 62 start to be fitted together at a position distant from the vicinity of the joint portion, the internal unit 12 is already at the proper position, and the fitting concave portion 61 and the fitting convex portion 62 are reliably fitted together even though the tapered surface 63 is not formed thereon.

(Other Modified Examples)

Although the sea centrifugal compressor 10 is described in this embodiment, the rotation mechanism according to the present invention is not limited thereto, and a rotation mechanism which is used in a narrow place where a sufficient surrounding space cannot be secured may be applied.

In addition, although the fitting convex portions 25 and 28 are formed on the heads 22 and the diaphragms 23 in this embodiment, the present invention is not limited thereto, and the fitting convex portions 25 and 28 may be formed on other members included in the internal unit 12.

In addition, although the fitting concave portion 16 is formed on the casing 11 and the fitting convex portions 25 and 28 are formed on the internal unit 12 in this embodiment, contrary to this, the fitting convex portions 25 and 28 may be formed on the casing 11 and the fitting concave portion 16 may be formed on the internal unit 12.

(Arrangement Example)

Figure 9:
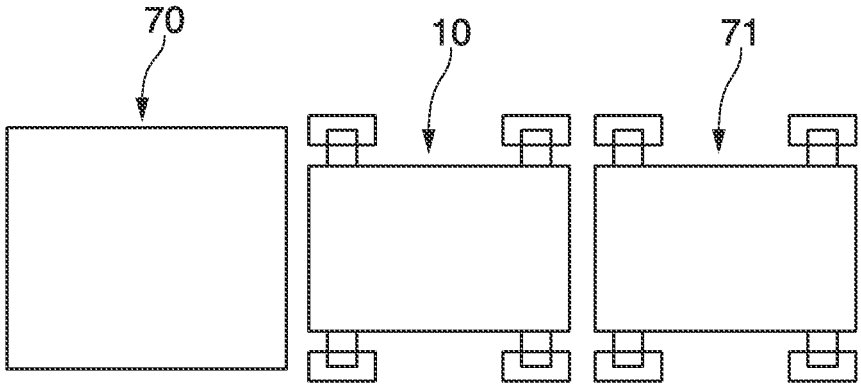
FIG. 9 is a schematic plan view illustrating an arrangement example of the sea centrifugal compressor according to the embodiment of the present invention.

Next, an arrangement example of the sea centrifugal compressor 10 according to the embodiment of the present invention will be described. FIG. 9 is a schematic plan view illustrating the arrangement example of the sea centrifugal compressor 10 according to this embodiment. The sea centrifugal compressor 10 is used for a low pressure having a low compression ratio and is disposed in a narrow space between a steam turbine 70 which is used for driving the compressor and a high-pressure compressor 71 having a high compression ratio. According to this arrangement, since the steam turbine 70 is disposed on one side of the sea centrifugal compressor 10 and the high-pressure compressor 71 is disposed on other side thereof, the space for taking the internal unit 12 out of the side of the casing 11 cannot be secured. However, in the sea centrifugal compressor 10, the casing 11 is configured to be vertically split into two portions, and the components other than the casing 11 are integrated with the internal unit 12. Therefore, as described above, by pulling up the internal unit 12 to be replaced with the spare internal unit 12, the maintenance of the sea centrifugal compressor 10 is facilitated. This effect can be obtained even when the tapered surfaces 18 and 27 are not formed on the fitting concave portion 16 of the casing 11 and the fitting convex portion 28 of the internal unit 12.

While the exemplary embodiments of the present invention have been described above, the present invention is not limited to the above-described embodiments. Additions, omissions, substitutions, and other modifications of the configuration can be made without departing from the gist of the present invention. The present invention is not limited to the above descriptions, and is limited only by the appended claims.

The present invention relates to the rotation mechanism in which the internal unit including the rotor that is driven to rotate around the axis thereof is accommodated in the casing. According to the rotation mechanism of the present invention, the maintenance can be facilitated by collectively replacing the internal unit, and the internal unit can be taken out without securing the surrounding space.

REFERENCE SIGNS LIST

10: sea centrifugal compressor
11: casing
12: internal unit
13: casing body
131: upper half portion
131*a*: flange
132: lower half portion
132*a*: flange
14: suction port
15: discharge port
16: fitting concave portion
17: side wall
18: tapered surface
19: rotor
191: rotating shaft
192: impeller
193: gas flow passage
20: bearing portion
201: journal bearing
202: thrust bearing

21: seal portion
22: head
23: diaphragm
24: bearing cover
25: fitting convex portion
26: side wall
27: tapered surface
28: fitting convex portion
29: guide bar
30: guide plate
301: mounting piece
302: protruding piece
40: axial movement restricting portion
41: fitting concave portion
411: bottom surface
412: vertical portion
42: fitting convex portion
421: top surface
422: vertical portion
43: side wall
44: side wall
45: tapered surface
46: tapered surface
50: axial movement restricting portion
51: fitting concave portion
52: fitting convex portion
53: side wall
54: side wall
55: tapered surface
56: tapered surface
57: side wall
58: side wall
60: axial movement restricting portion
61: fitting concave portion
62: fitting convex portion
63: tapered surface
70: steam turbine
71: high-pressure compressor
C1: first center line
C2: second center line
W: wire

The invention claimed is:

1. A rotation mechanism for a compressor, comprising:

a casing which is configured to be vertically split into two portions and includes an upper half portion on an upper side and a lower half portion on a lower side;

an internal unit which is disposed in the casing and has a configuration in which a rotor which rotates around an axis thereof, a bearing portion which rotatably supports the rotor, and an annular seal portion which seals a gap surrounding a circumferential surface of the rotor and thereby enables the rotor to rotate are integrated; and an axial movement restricting portion which includes a fitting concave portion provided in the casing and formed to extend along a circumferential direction of the casing, and a fitting convex portion provided in the internal unit to be fitted into the fitting concave portion and formed to extend along the circumferential direction, the axial movement restricting portion which restricts relative movement between the casing and the internal unit in an axial direction of the rotation mechanism;

wherein a bottom portion of the fitting concave portion includes a first side wall on a forward side in a direction with respect to an axial force applied to the internal unit and a second side wall on a rearward side in the direction of the axial force applied to the internal unit, the first side wall has a first vertical portion perpendicular to a bottom surface of the fitting concave portion, the second side wall has a second vertical portion perpendicular to the bottom surface of the fitting concave portion and facing the first vertical portion, and a concave side tapered surface formed on an opening edge portion of the fitting concave portion, a tip end portion of the fitting convex portion includes a third side wall on the forward side in the direction with respect to the axial force applied to the internal unit and a fourth side wall on the rearward side in the direction of the axial force applied to the internal unit, the third side wall has a third vertical portion perpendicularly connected to a top surface of the fitting convex portion, the fourth side wall has a fourth vertical portion perpendicular to the top surface of the fitting convex portion and facing the third vertical portion, and a convex side tapered surface formed on a base end portion of the fitting convex portion, and the concave side tapered surface and the convex side tapered surface are formed only on a part of each fitting concave portion and fitting convex portion adjacent to a joint portion of the upper half portion and the lower half portion of the casing.

2. An internal unit of a rotation mechanism for a compressor, which is disposed in a casing that is configured to be vertically split into two portions and includes an upper half portion on an upper side and a lower half portion on a lower side, and has a configuration in which a rotor which rotates around an axis thereof, a bearing portion which rotatably supports the rotor, and an annular seal portion which seals a gap surrounding a circumferential surface of the rotor and thereby enables the rotor to rotate are integrated, the internal unit comprising:

an axial movement restricting portion which includes a fitting concave portion provided on the casing formed to extend along a circumferential direction of the casing, and a fitting convex portion provided on the internal unit to be fitted into the fitting concave portion and formed to extend along the circumferential direction, the axial movement restricting portion which restricts relative movement between the casing and the internal unit in an axial direction of the rotation mechanism;

wherein a bottom portion of the fitting concave portion includes a first side wall on a forward side in a direction with respect to an axial force applied to the internal unit and a second side wall on a rearward side in the direction of the axial force applied to the internal unit, the first side wall has a first vertical portion perpendicular to a bottom surface of the fitting concave portion, the second side wall has a second vertical portion perpendicular to the bottom surface of the fitting concave portion and facing the first vertical portion, and a concave side tapered surface formed on an opening edge portion of the fitting concave portion, a tip end portion of the fitting convex portion includes a third side wall on the forward side in the direction with respect to the axial force applied to the internal unit and a fourth side wall on the rearward side in the direction of the axial force applied to the internal unit, the third side wall has a third vertical portion perpendicular to a top surface of the fitting convex portion, the fourth side wall has a fourth vertical portion perpendicular to the top surface of the fitting convex portion and facing the third vertical portion, and a convex side tapered surface formed on a base end portion of the fitting convex portion, and the concave side tapered surface and the convex side tapered surface are formed only on a part of each fitting concave portion and fitting convex portion adjacent to a joint portion of the upper half portion and the lower half portion of the casing.

* * * * *